United States Patent [19]

Britt et al.

[11] 4,026,413

[45] May 31, 1977

[54] PLASTICS STRIPS

[76] Inventors: John Philip Britt, 1 Chichester Drive, Springfield, Chelmsford; Eric Henry Wilson, 32 Tabors Ave., Great Braddow, Chelmsford, both of England

[22] Filed: Aug. 1, 1975

[21] Appl. No.: 601,064

Related U.S. Application Data

[63] Continuation of Ser. No. 412,289, Nov. 2, 1973, abandoned.

[52] U.S. Cl. ..... 206/343; 24/30.5 S; 24/264; 206/820

[51] Int. Cl.² ..... B65D 85/24

[58] Field of Search ..... 206/330, 343, 344, 390, 206/820; 24/264, 30.5 S, 30.5 L, 130

[56] References Cited

UNITED STATES PATENTS

| | | | |
|---|---|---|---|
| 2,082,577 | 6/1937 | Herschmann | 206/343 |
| 2,937,464 | 5/1960 | Marshall | 40/2 |
| 3,164,249 | 1/1965 | Paxton | 206/343 |
| 3,270,872 | 9/1966 | Paxton | 206/820 |
| 3,270,873 | 9/1966 | Paxton | 206/343 |
| 3,270,874 | 9/1966 | Paxton | 206/343 |
| 3,767,039 | 10/1973 | Schroter | 206/390 |
| 3,819,041 | 6/1974 | Cunningham | 206/390 |

*Primary Examiner*—Ro E. Hart
*Assistant Examiner*—Bruce H. Bernstein
*Attorney, Agent, or Firm*—Robert F. O'Connell

[57] ABSTRACT

A strip of plastics tags is formed by successively displacing portions of the strip from the plane of the strip along longitudinally spaced lines transverse of the strip, and, before contact between said displaced portions and the remainder of the strip is lost, replacing said portions in the plane of the strip.

3 Claims, 11 Drawing Figures

PLASTICS STRIPS

This is a continuation of application Ser. No. 412,289, filed Nov. 2, 1973, now abandoned.

This invention relates to plastic strips, and more particularly to the production of frangible strips of plastics sheet materials having regularly spaced therealong substantially parallel transverse planes of fracture, from which strips a plurality of lamellar units may be removed by the successive flexing of the strip along the planes of fracture.

The invention is directed in particular, though not exclusively, to the manufacture of continuous strips of securing devices of the kind comprising a blank of plastics sheet material formed with a slit extending inwardly from an edge of the blank into an aperture formed therein, such that the gathered mouth of a bag or like wrapping may be inserted into the aperture and securely held therein.

It is known to produce strips of such securing devices wherein the devices are formed with an inwardly tapering throat from an edge of the blank to the slit and the individual devices of the strip are interconnected by forming a portion of the edge on each side of the throat of one device integrally with corresponding portions of the edge of the preceding device in the strip opposite that edge of the preceding device from which tapers the throat of that device. Such an arrangement combines frangibility with high tensile strength permitting the easy separation of individual securing devices on flexing of the strip, while allowing the strip to be, for example, tightly reeled for handling and storage without concommitant strip fracture. However, the arrangement does not permit the production of strips in which the individual devices are interconnected side-by-side rather than end-to-end, that is, with the throat of each device tapering from an edge of the device in the side edge of the strip, and for some applications this alternative arrangement is preferred.

It is also known to produce strips of securing devices of the kind referred to, in which adjacent devices in the strip are formed integrally with and separated by interconnecting frangible webs, the webs being designed to separate completely from the devices which they interconnect on fracturing of the strip. This arrangement permits end-to-end or side-to-side configurations, but the formation of the interconnecting webs is wasteful of material and the finished strip has a rather low tensile strength. There is also presented the problem of disposing of the waste webs separated from the strip during use.

It is therefore an object of the present invention to provide a frangible strip of plastics material such as a strip of securing devices of the kind referred to, wherein the individual units are joined side-by-side and which may be produced with minimal waste of sheet material. It is a further object of the invention to provide a method of manufacturing continuous strips of lamellar units, which strips have sufficient tensile strength to withstand routine handling and yet which fracture readily on flexing to allow separation of the units.

In accordance with various features of the invention, a strip of plastics material has longitudinally spaced therealong transverse planes of fracture delimiting sequential lamellar units, which units can be removed from the strip by fracturing the strip successively at said planes of fracture, each of the planes being defined by two or more colinear portions of the strip, the material of the strip between said portions being cut through without substantial elimination of said material from the strip. The material is preferably cut through along a straight line which extends across the longitudinal axis of the strip, terminating at each end thereof short of the edges of the strip, and may be further cut through along two other lines, colinear with said straight line, and extending each from a respective side edge of the strip towards a respective end of the straight line.

The strip can be manufactured by a method which comprises the step of displacing a portion of a strip of sheet plastics material from the plane of the sheet and returning the displaced portion to the said plane before physical contact is lost between the portion and the remainder of the strip, preferably producing thereby, for each lamellar unit, one or more flaps, each flaps having at least one straight edge, the colinear portions of the strip defining each plane of fracture thereof being located at ends of the straight edges of the flaps.

In a preferred embodiment of the invention, the strip comprises a plurality of closure devices united edge-to-edge, each of the devices comprising a lamella of substantially rectangular plan having an aperture formed internally therein, and a slit extending from the aperture to a side of the device located in a longitudinal side edge of the strip, each device being formed at an edge thereof with one or more projections extending in the plane of the device into the substantially rectangular plan of a next adjacent device in the strip, to hold together said device and said next adjacent device, the projections preferably being formed integrally with both said device and the next adjacent device.

The invention will be described with reference to the accompanying drawings in which.

Figure 1:
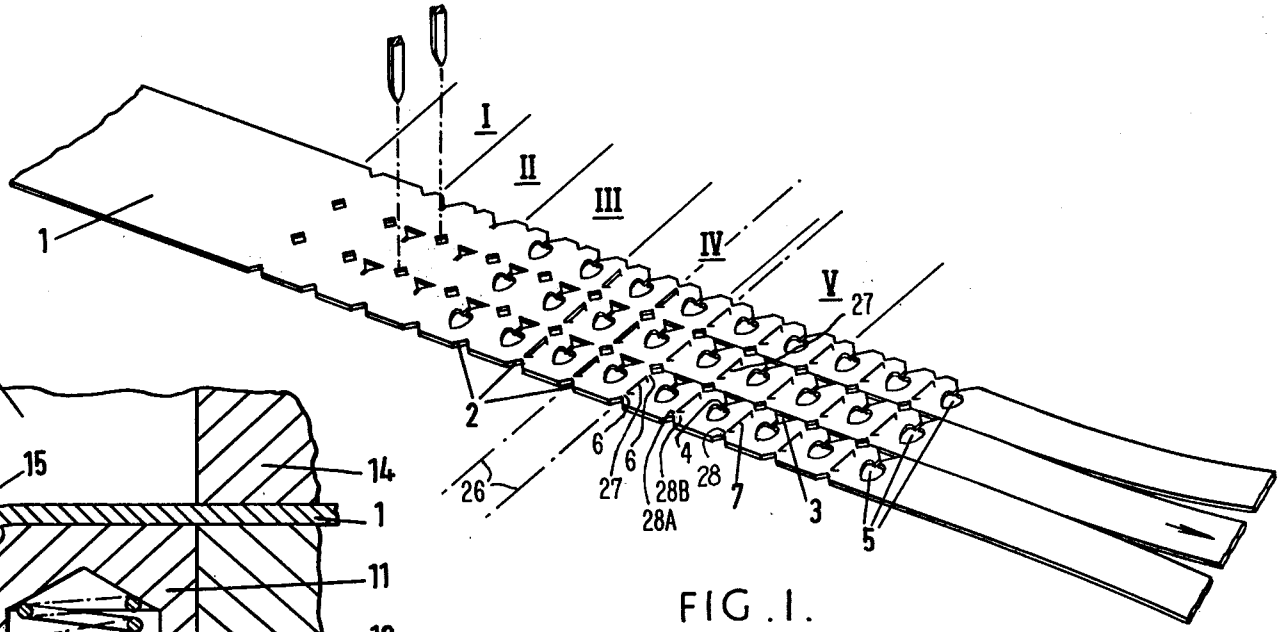
FIG. 1 illustrates diagrammatically the progress of a sheet of plastics material through a die-punching operation.

In FIG. 1, a sheet 1 of plastics material is passed intermittently through a die-punch apparatus (not shown) in the direction of the arrow. The component parts of a securing device of the kind hereinbefore referred to are formed successively in the stock, the sheet advancing twice the width of the securing device at each cycle of operation. In the embodiment illustrated, six securing devices are manufactured simultaneously in three continuous strips. Each securing device is generally rectangular in shape and comprises chamfered corners 2, which are formed at station I, an inwardly tapering throat 3 leading from a shorter edge and terminating in a slit 4, which are formed simultaneously at station II, and an aperture 5, into which leads the slit 4, the apertures being formed at station III. Adjacent units in the strip are interconnected along their longer edges by trapezoidal, or dove-tail, shaped unsevered portions 6 of the sheet material which are formed at station IV by displacing portions of the sheet from the plane of the sheet to form flaps 7. The sheet is planished at station V to return these displaced portions to the common plane, and simultaneously separated into the constituent strips which are led out for reeling.

Figure 1A:
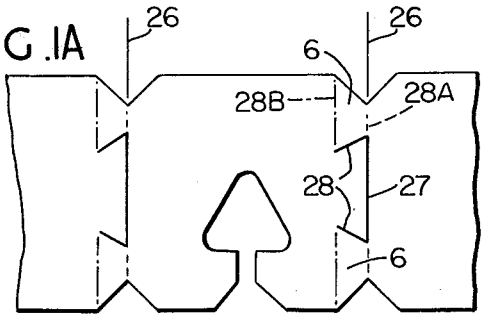
FIG. 1A illustrates an enlarged view of a portion of FIG 1.
Figure 2:
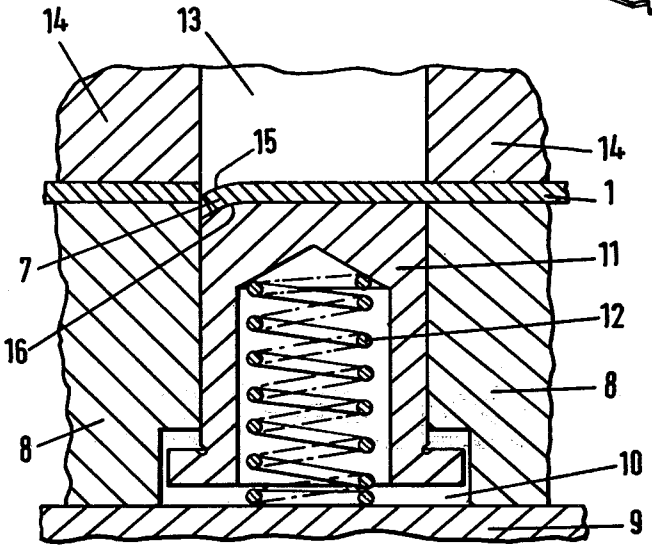
FIGS. 2 and 3 illustrate in section a portion of the die-punch apparatus operating in the region A—A of FIG. 1.
Figure 3:
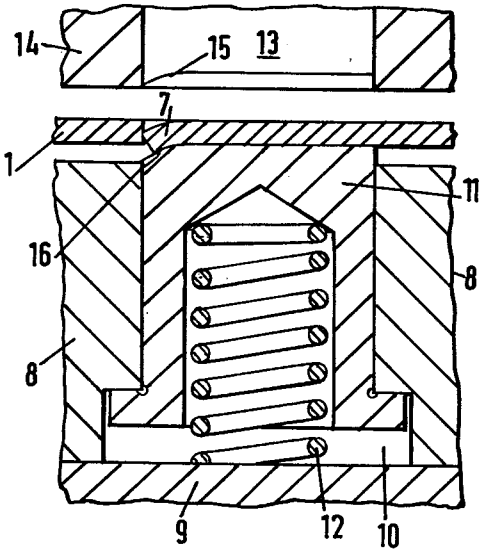

FIG. 2 shows the punching operation for the formation of the flaps 7. Adjacent units are delimited by transverse planes of fracture 26 each defined by a single transverse cut 27, as shown in FIGS. 1 and 1A. As seen more specifically in the enlarged view of FIG. 1A, one side of each of the dove-tail shaped unsevered portions 6 is defined by one of a pair of additional cuts 28 extending from the ends of transverse cut 27 into only one of the units so that a first end of each unsevered portion 6 designated by dot-dash line 28A coincides with plane 26 and a second end thereof designated by dot-dash line 28B is within the area of the said one unit, the second end being wider than the first end. Because of the presence of cuts 27 and 28, stress is concentrated at such first ends (i.e., along lines 28A) of each portion 6 so that separation occurs along the lines 28A and the transverse cut 27. The die punch apparatus comprises a die block 8 supported on a bolster 9 and into the die cavity 10 of which is inserted an ejector 11 operating against a compression spring 12. The punch 13 is carried between spring-loaded strippers 14 which restrain the sheet 1 against the die block during the punching operation. The working edge 15 of the punch conforms with the head surface 16 of the ejector. In FIG. 3 is shown the die punch apparatus and sheet stock after completion of the cycle. The stock is subsequently moved in the direction of the arrow to a planishing station where the flap 7 is returned to the plane of the sheet by compression between flat surfaces.

Figure 4:
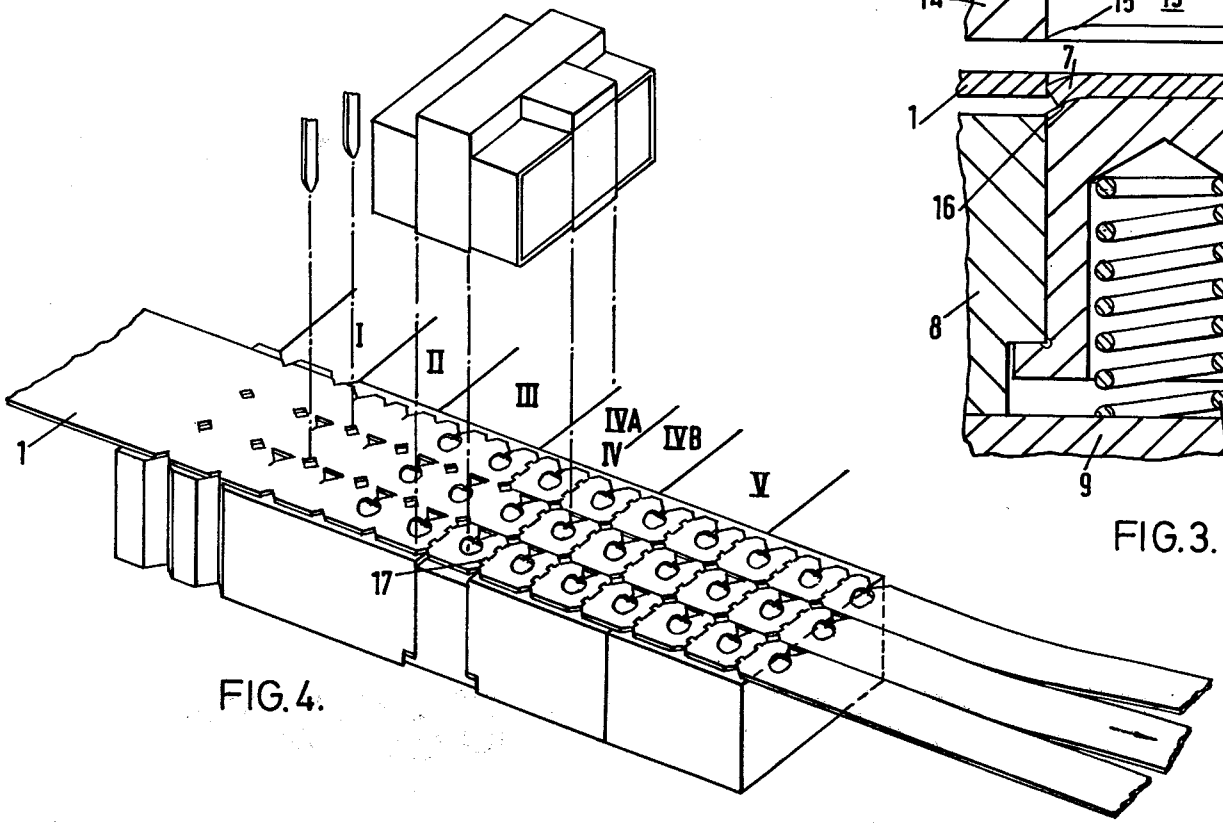
FIG. 4 illustrates diagrammatically an alternative embodiment of the invention.

In FIG. 4 is shown an alternative embodiment in which the individual securing devices are fully defined at station IV. Thus complete units are punched in alternate strips at IVA while the included strips are punched simultaneously at IVB. The displacement of the units is insufficient to allow their separation from the sheet stock and they are retained in interlocking relationship by virtue of the dovetails, 17 and conveyed to the planishing area at station V where the units are returned to a common plane.

Figure 5:
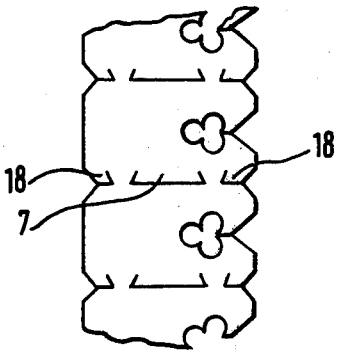
Figure 6:
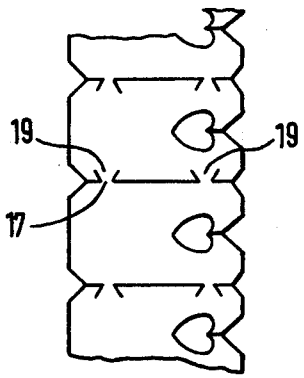
FIGS. 6, 7 and 8 illustrate alternative preferred configurations of the plastics strip produced in accordance with the invention.
Figure 7:
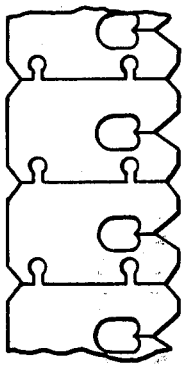
Figure 8:
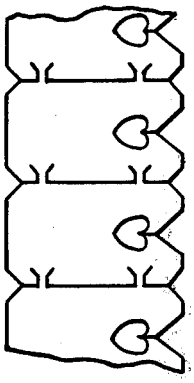

FIGS. 5, 6, 7 and 8 show alternative configurations of the units in strips produced in accordance with the invention. The embodiment illustrated in FIG. 5 is similar to that of FIG. 1 except that further flaps 18 are formed between flap 7 and the edges of the strip. The embodiment of FIG. 6 may suitably be manufactured by a process similar to that described with reference to FIG. 4 with the exception that the units are not fully defined at station IV, the fans 19 of the dovetails 17 remaining unsevered. The embodiments of FIGS. 7 and 8 provide a strip from which individual securing devices may be separated by lateral relative displacement of the terminal unit and the remainder of the strip, as well as by flexing the strip.

Figure 9:
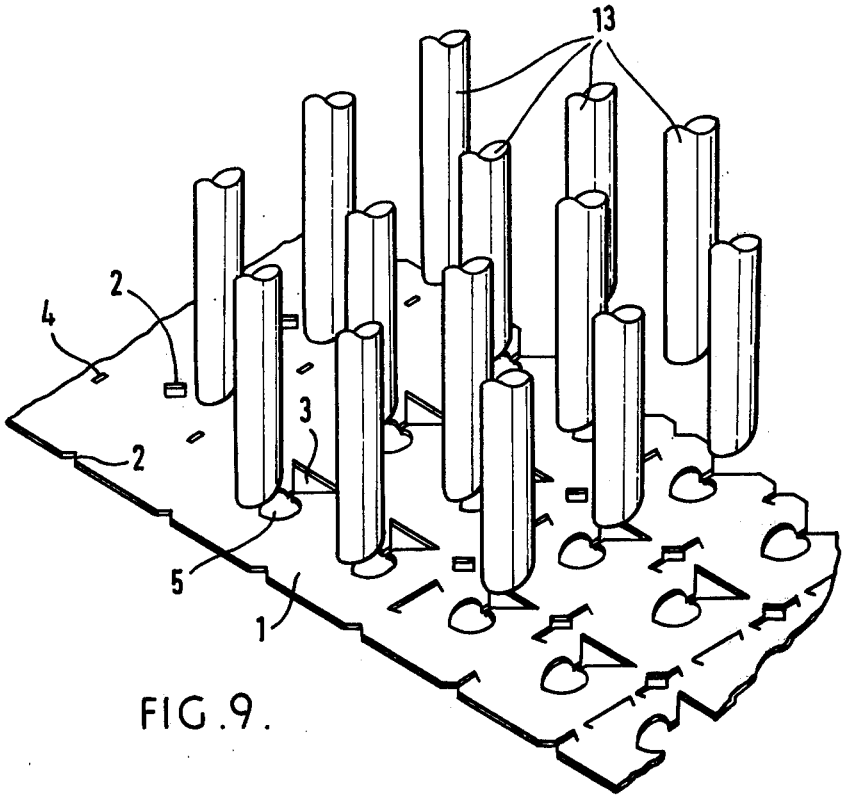
FIG. 9 illustrates diagrammatically a further embodiment of the invention in the course of production, showing the relative locations of certain of the punches in the die-press.

In FIG. 9 is shown a further preferred embodiment of the invention in the course of manufacture. A sheet 1 of plastics material is passed intermittently through a die-press (not shown) in the direction of the arrow. The sheet is advanced by an amount equal to the length of the arrow, that is, twice the width of the units in the strip, at each cycle of operation of the die-press. In this embodiment, slits 4 and corners 2 of the units are formed in the sheet stock in the first cycle of operation as the stock enters the press, throats 3 and apertures 5 are formed in the second cycle and the stock is slit longitudinally into three adjacent strips of units at the fifth cycle of operation. For the sake of clarity, the punches by which these operations are performed are not illustrated in the figure. At the third and fourth cycles, the punches 13 operate to form flaps 7 and 18 which are planished at the immediately succeeding cycle of operation of the die-press. Flaps 7 and 18 are spaced apart across the width of the strip by a distance of between 1/10th and 1/40th of an inch, preferably 1/25th of an inch.

Figure 10:
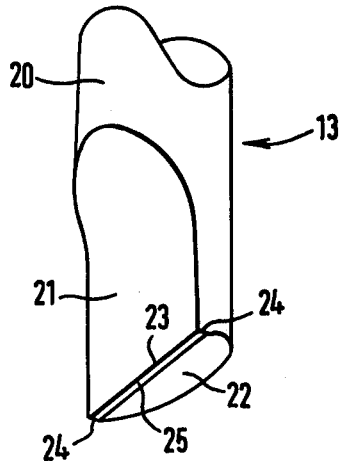
FIG. 10 is a detail of the punches shown in FIG. 9.

FIG. 10 shows a detail of the punch 13 used for forming flaps 7 and 18. The punch comprises a cylindrical shank 20 from which is ground a flat 21 to leave a substantially semicircular working face 22. Edges 23 and 24 at the end of the shank 20 are ground square to provide the cutting edges of the tool, and the face 22 is chamfered to form an angle of approximately 75° with the axis of the shank, there being left a land 25 immediately behind the edge 23, preferably about 0.01 inches wide. The provision of the land 25 prolongs the life of the tool by strengthening the edge 23 against chipping etc. Also, as the edges 23, 24 become blunted with use, the land 25 can be ground down a few thou to restore the keenness of the tool.

In the practice of this invention, any frangible plastics sheet material may be employed, a preferred plastics material being high-impact polystyrene such as the compositions sold under the trade names "Bextrene" and "Celetron". Such compositions are made to British Standard Specification B.S. 3241(1960) and B.S. 3290(1960) for sheet polystyrene stock.

We claim:

1. A strip of stiffly resilient sheet plastics material comprising a plurality of closure devices united edge to edge and delimited by transverse planes of fracture each defined by at least one transverse cut, each closure device having an aperture formed integrally therein and slit extending from the aperture to a side of the device and each closure device being united to the next adjoining device by a plurality of narrow unsevered portions integral with both said devices the said unsevered portions being defined by additional cuts each extending from an end of a said transverse cut into only one of the two adjoining closure devices, whereby each unsevered portion has a first end integral with the other of the said two adjoining closure devices and substantially coinciding with a said fracture plane and a second end spaced from said plane and within the area of and integral with the said one closure device, so that on application of a transverse force to a closure device of the strip the unsevered portions will break at their first ends and remain integral at their second ends.

2. A strip according to claim 1 wherein each said transverse plane of fracture is defined by a plurality of colinear transverse cuts and each said unsevered portion is defined by two additional cuts each extending from one of said transverse cuts.

3. A strip according to claim 1 wherein the said second end is wider than the said first end.

* * * * *